US006354877B1

(12) United States Patent
Shuey et al.

(10) Patent No.: US 6,354,877 B1
(45) Date of Patent: Mar. 12, 2002

(54) HIGH SPEED MODULAR ELECTRICAL CONNECTOR AND RECEPTACLE FOR USE THEREIN

(75) Inventors: Joseph B. Shuey, Camp Hill; Stuart C. Stoner, Lewisberry, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/625,106

(22) Filed: Jul. 25, 2000

Related U.S. Application Data

(63) Continuation of application No. 09/242,611, filed as application No. PCT/US97/14631 on Aug. 20, 1997, now abandoned.

(60) Provisional application No. 60/024,220, filed on Aug. 20, 1996.

(51) Int. Cl.[7] ..... H01R 13/648

(52) U.S. Cl. ..... 439/608; 439/701

(58) Field of Search ..... 439/608, 607, 439/101, 701, 108

(56) References Cited

U.S. PATENT DOCUMENTS

| | | | | |
|---|---|---|---|---|
| 4,973,260 | A | 11/1990 | Madore et al. | 439/101 |
| 5,066,236 | A | 11/1991 | Brooksteeg | 439/608 |
| 5,104,341 | A | 4/1992 | Gilissen | |
| 5,429,521 | A | 7/1995 | Morlion et al. | 439/108 |
| 5,433,618 | A | 7/1995 | Morlion et al. | 439/608 |
| 5,518,422 | A | 5/1996 | Zell et al. | 439/608 |
| 5,672,064 | A | 9/1997 | Provencher et al. | 439/608 |
| 5,718,606 | A | 2/1998 | Rigby et al. | 439/608 |

FOREIGN PATENT DOCUMENTS

| | | |
|---|---|---|
| DE | 4040551 | 12/1989 |
| EP | 0 746 060 | 12/1996 |

*Primary Examiner*—Gary Paumen
(74) *Attorney, Agent, or Firm*—M. Richard Page; Steven M. Reiss

(57) ABSTRACT

A shield arrangement for an electrical connector, comprising: an external conductive shield and an internal conductive shield. The external conductive shield encloses the electrical connector and has at least one inwardly directed projection. The internal conductive shield at least partially resides within the electrical connector and has at least one feature engaging the at least one projection. Preferably, the electrical connector is a receptacle.

19 Claims, 14 Drawing Sheets

HIGH SPEED MODULAR ELECTRICAL CONNECTOR AND RECEPTACLE FOR USE THEREIN

CROSS-REFERENCE TO RELATED APPLICATIONS

This application is a continuation of U.S. patent application Ser. No. 09/242,611 filed on Apr. 1, 1999 and now abandoned, herein incorporated by reference, which is a national stage of PCT/US97/14631 filed Aug. 20, 1997.

This application claims benefit of Provisional Application No. 60/024,220 filed Aug. 20, 1996.

BACKGROUND OF THE INVENTION

1. Field of the Invention

The present invention relates to electrical connectors and more particularly to modular connectors for use in connecting a daughter printed wiring board to a mother printed wiring board.

2. Brief Description of Prior Developments

In the manufacture of computers and various other electronic assemblies, daughter boards are commonly connected to mother boards by means of a connector having a receptacle having a plastic housing and a first and second face wherein terminals are connected in one face to the daughter board and at the other to a header connected to the mother board. Various arrangements have been suggested to ground such connectors to the mother or daughter boards but such arrangements have tended to complicate the construction of the connector. A need, therefore, exists for simple and inexpensive means for grounding connectors between mother and daughter boards. There is also a need for such a connector which reduces crosstalk and increases band width.

SUMMARY OF THE INVENTION

The shield arrangement of the present invention comprises an external conductive shield and an internal conductive shield. The external shield encloses the electrical connector and has at least one inwardly directed projection. The internal shield at least partially resides within the electrical connector and has at least one feature engaging the at least one projection.

The electrical connector of the present invention comprises: a housing; a plurality of contacts; an external conductive shield; and an internal conductive shield. The contacts extend through the housing. The external shield encloses the housing and has at least one inwardly directed projection. The internal shield at least partially resides within the housing and has at least one feature engaging the at least one projection.

The receptacle electrical connector of the present invention comprises: a housing; a plurality of contacts; an external conductive shield; and an internal conductive shield. The housing has a front face with a plurality of apertures arranged in a plurality of columns. The contacts are also arranged in a plurality of columns in the housing, each contact having a mating end adjacent a corresponding openings. The external conductive shield encloses the housing and has at least one inwardly directed projection. The internal conductive shield at least partially resides within the housing at a location between adjacent columns of contacts, and has at least one feature engaging the projection.

BRIEF DESCRIPTION OF THE DRAWINGS

The present invention is further described with reference to the accompanying drawings in which.

DETAILED DESCRIPTION OF THE PREFERRED EMBODIMENTS

Figure 1:
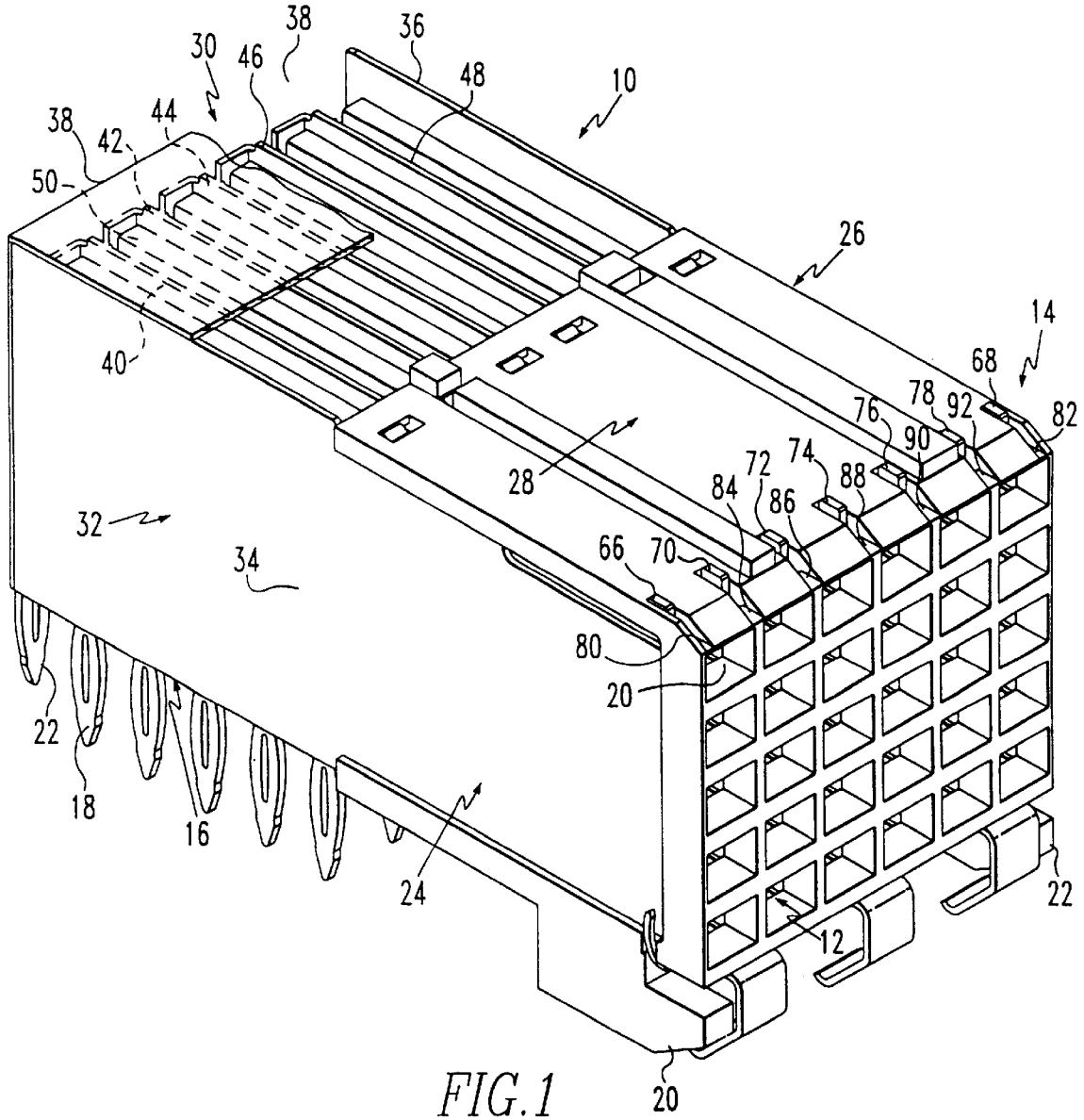
FIG. 1 is a cut-away perspective view of the receptacle of the present invention.
Figure 2:
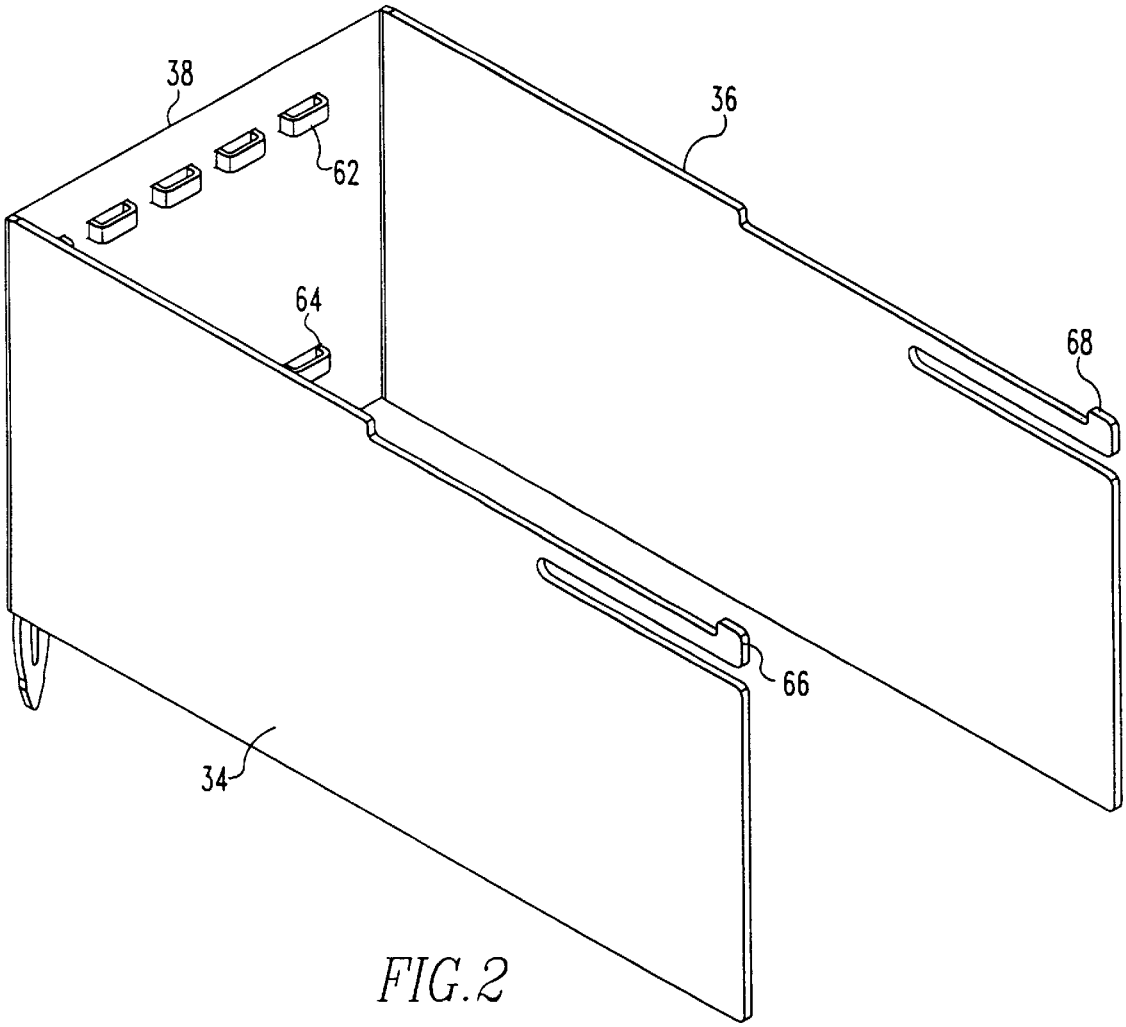
FIG. 2 is a perspective view of the exterior shielding used in the receptacle shown in FIG. 1.

Referring particularly to FIGS. 1–2, the receptacle is shown generally at numeral 10. The receptacle has a first face 12 on a front insulative housing shown generally at numeral 14. The receptacle also has a second face 16 on its bottom side, and conductive signal terminals as at 18 extend from the first face to the second face. The first face has a plurality of openings as at 20 where, as is explained hereafter, pins from a header engage the signal terminals. As is conventional, the receptacle also includes ground pins as at 22. The receptacle also includes lateral longitudinal sides 24 and 26 and a top longitudinal side 28. In opposed relation to the first face there is an end 30. The longitudinal 24 and 26 and the end 30 are covered by a U-shaped shield 32. This shield is comprised of longitudinal sections 34 and 36 which are superimposed, respectively over longitudinal sides 24 and 26. In section 38 of the U-shaped shield 32 is superimposed over the end 30 of the receptacle 30. On longitudinal side 28 rearwardly of the insulative housing there is also a top shield (shown in FIG. 1).

Figure 3:
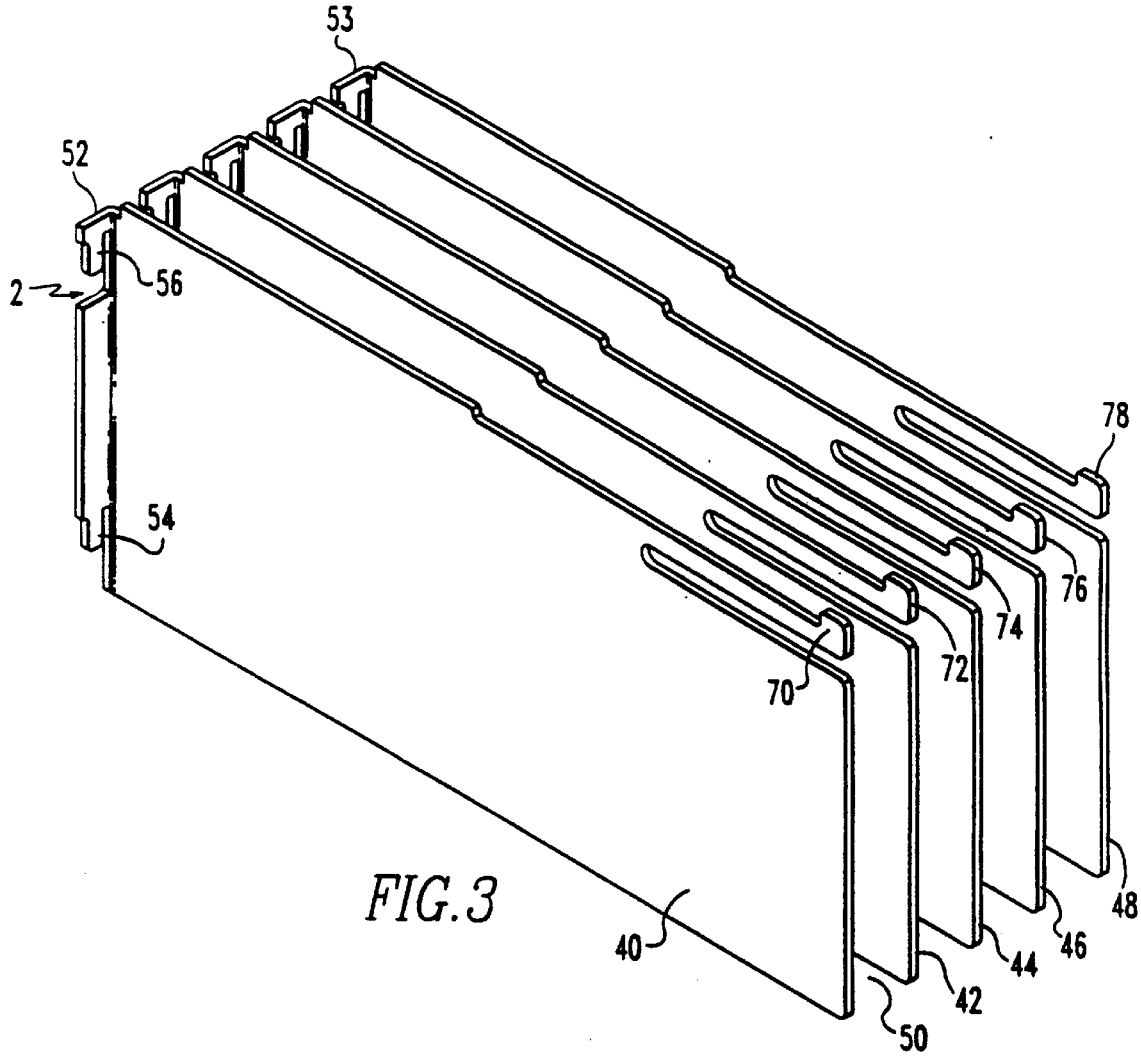
FIG. 3 is a perspective view of the interior shielding used in the receptacle shown in FIG. 1.
Figure 6:
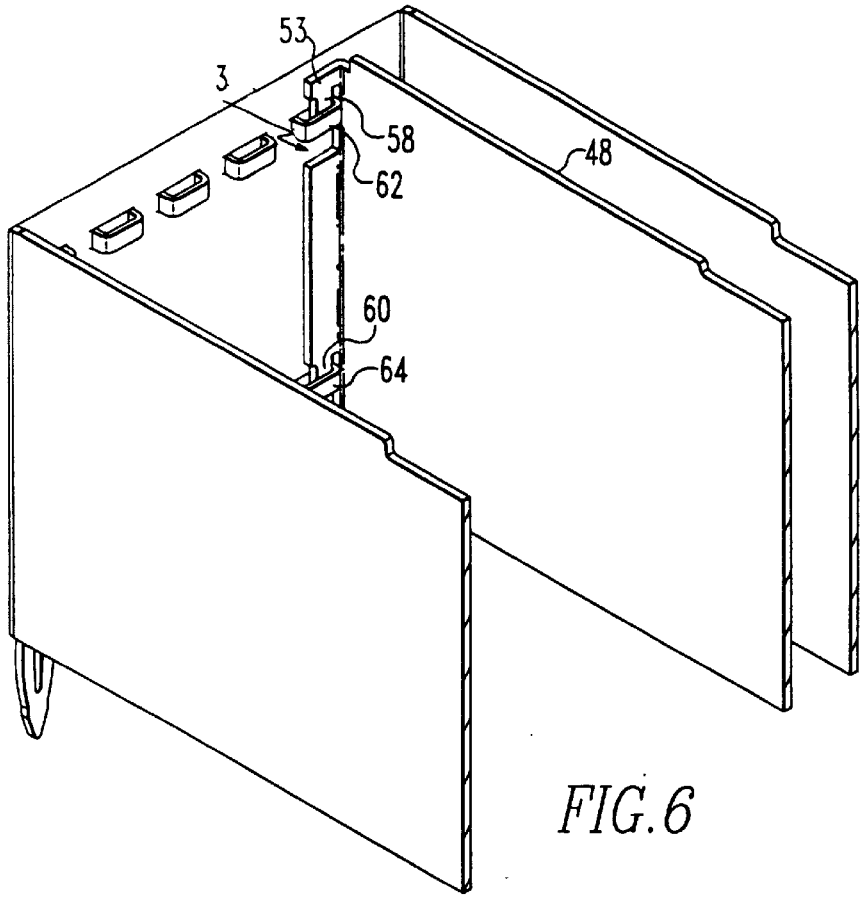
FIG. 6 is a perspective view of the exterior shielding engaged to one of the interior shields.

Referring particularly to FIGS. 1, 3 and 6, there are parallel longitudinal internal shielding walls 40, 42, 44, 46 and 48. Between these internal walls there are longitudinal spaces as at 50 (FIG. 3). Each of the internal walls also has a transverse section as at 52 and 53 (FIG. 3). Each of these transverse sections has a notch located in an area as at 2 on transverse section 52 and 3 on transverse section 53, and a pair of vertical latches as at 54 and 56 on transverse section 52 and 58 and 60 on transverse section 53. These vertical latches engage horizontal eyelets as at 62 and 64 (FIGS. 2 and 6). Horizontal eyelet 62 is shown extending into notch 3 (FIG. 6). On the front top edge of the longitudinal section 34 of U-shaped shield 32 there is a spring latch 66. On the front top section of longitudinal section 36 of the U-shaped shield 32 there is also a spring latch 68. Similarly internal shielding wall 40 has a front spring latch 70, internal shielding wall 42 has a shielding latch 72, internal shielding wall 44 has a front spring latch 74, internal shielding wall 46 has a front shielding latch 76 and internal shielding wall 48 has a front spring latch 78.

Figure 4:
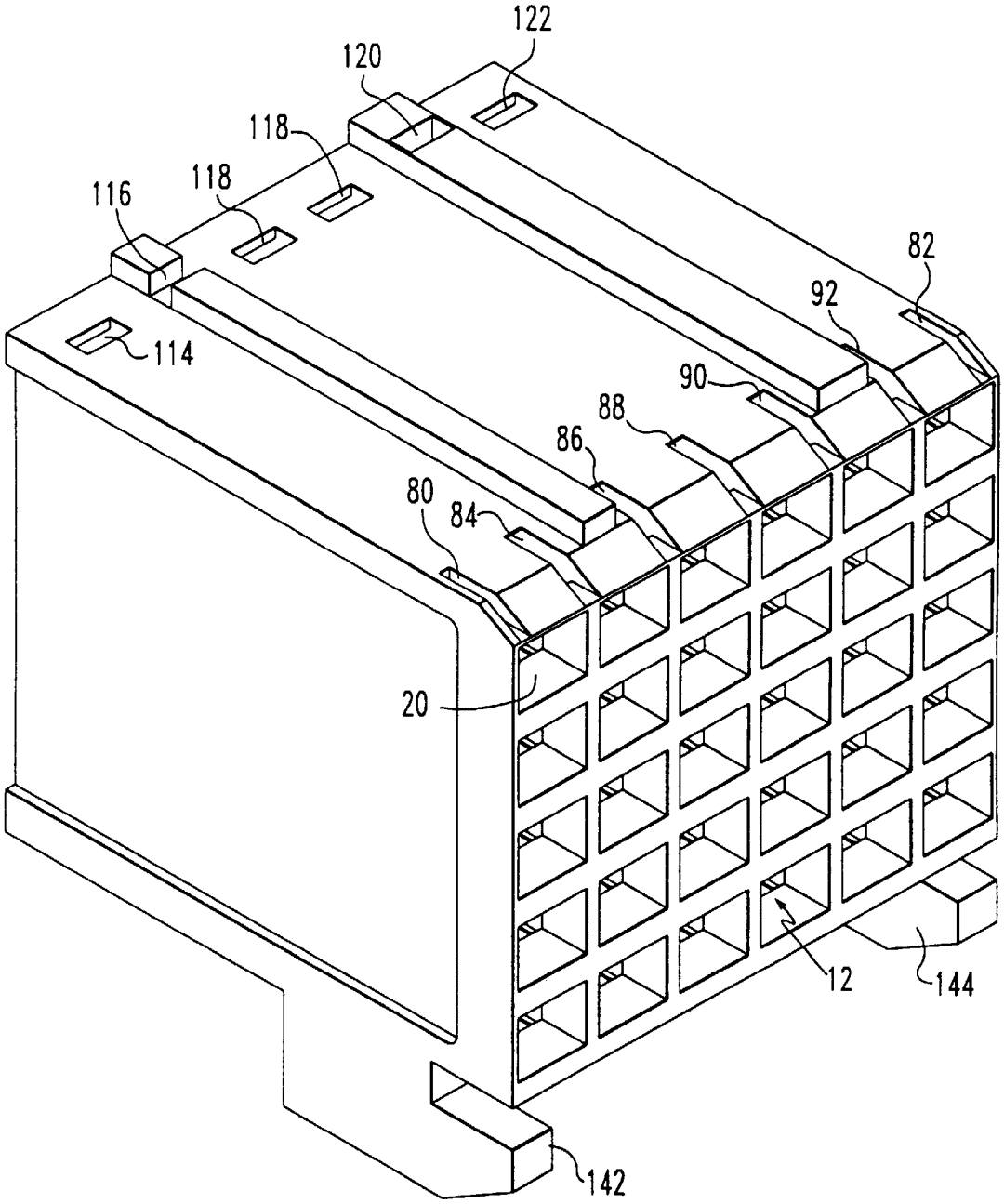
FIG. 4 is a perspective view of the insulative housing used in the receptacle shown in FIG. 1.

Referring particularly to FIG. 4, there are side slots 80 and 82 in the insulative housing. These slots are engaged, respectively, by spring latches 68 and 70. Between these slots there are medial slots 84, 86, 88, 90 and 92 which are engaged, respectively, by spring latches 70, 72, 74, 76 and 78 on the internal shielding walls.

Figure 5:
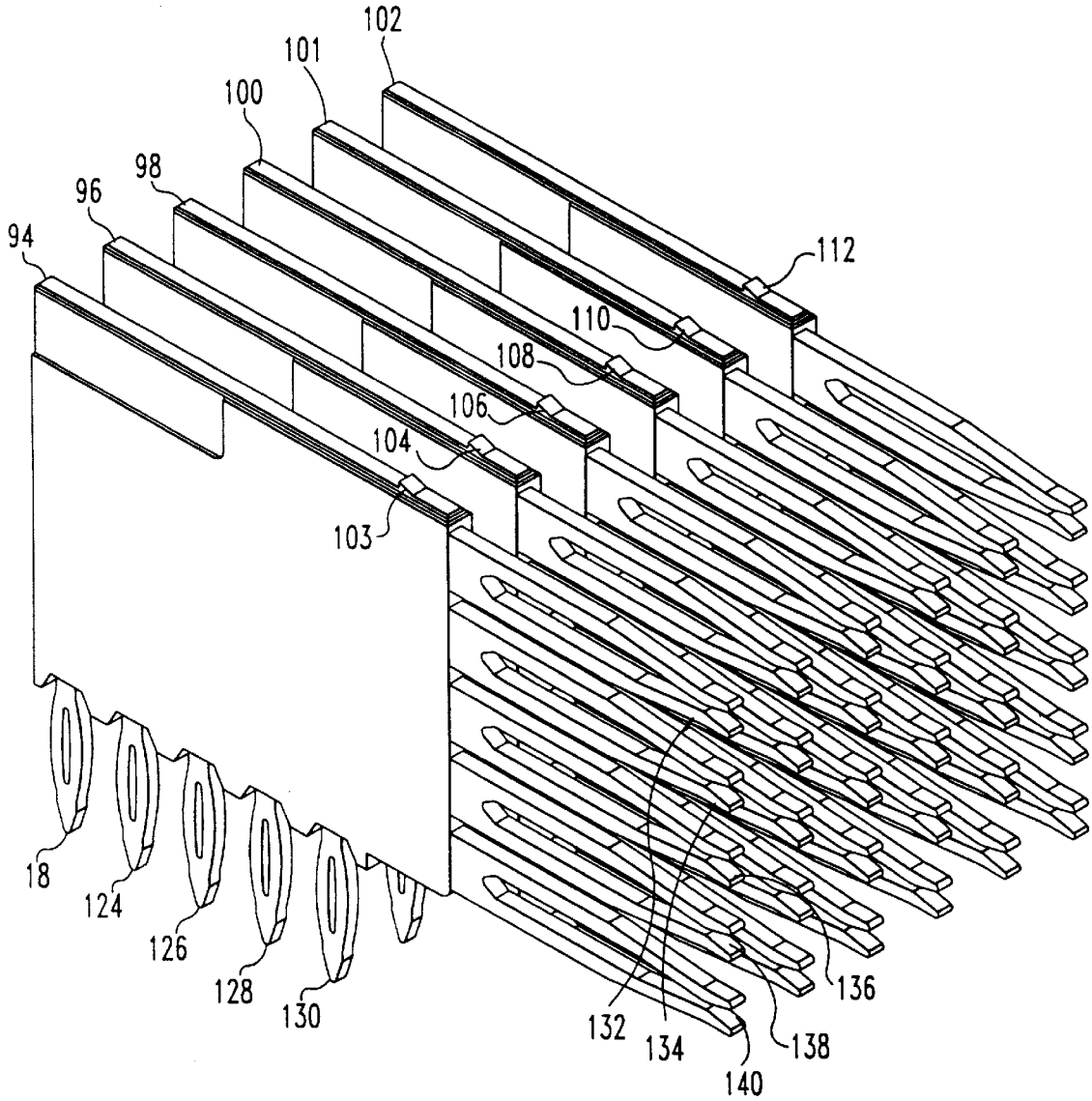
FIG. 5 is a perspective view of the composite terminals and insulative frames used in the receptacle shown in FIG. 1.

Referring particularly to FIGS. 1 and 4–5, it will be seen that the terminals are enclosed within insulative frames 94, 96, 98, 100, 101 and 102. These frames have, respectively, frame latches 103, 104, 106, 108, 110 and 112. These frame latches engage, respectively, apertures 114, 116, 118, 120 and 122 in the insulative housing (FIG. 1).

Figure 8:
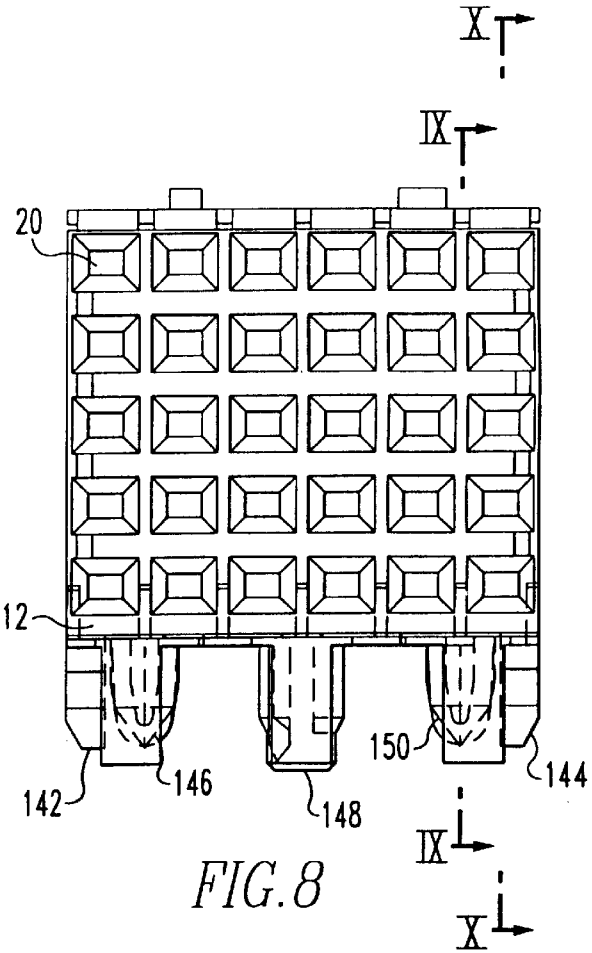
FIG. 8 is a front elevational view of the receptacle shown in FIG. 1.
Figure 7:
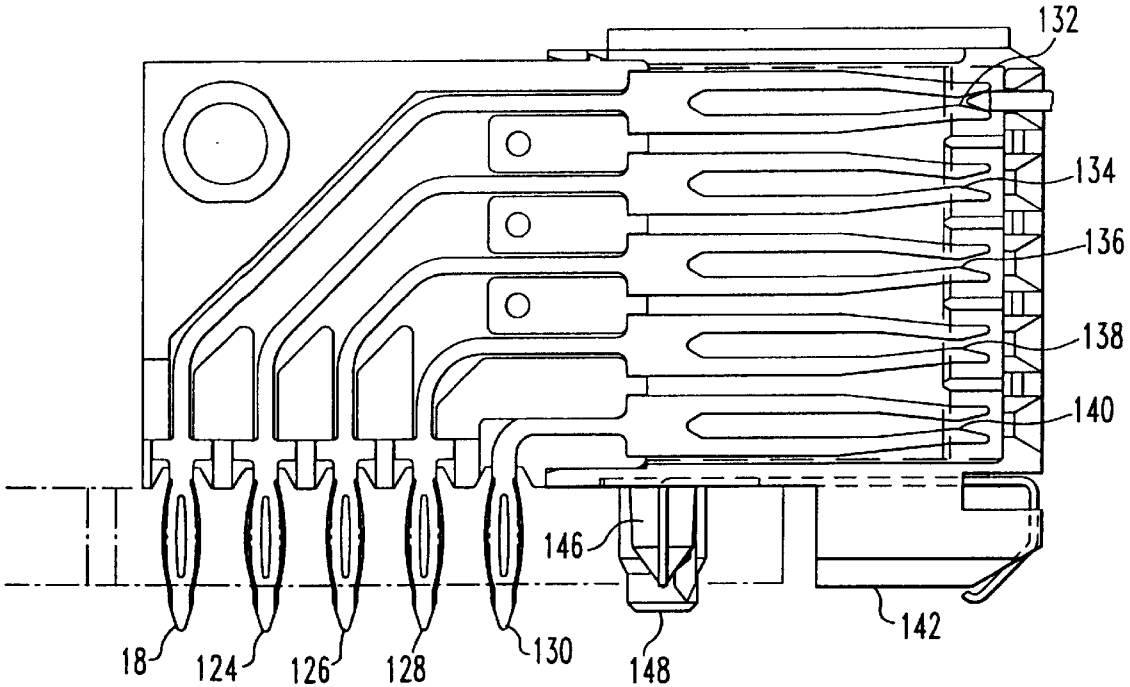
FIG. 7 is a side elevational view of the receptacle shown in FIG. 1 which is cut-away to show terminal arrangement.
Figure 9:
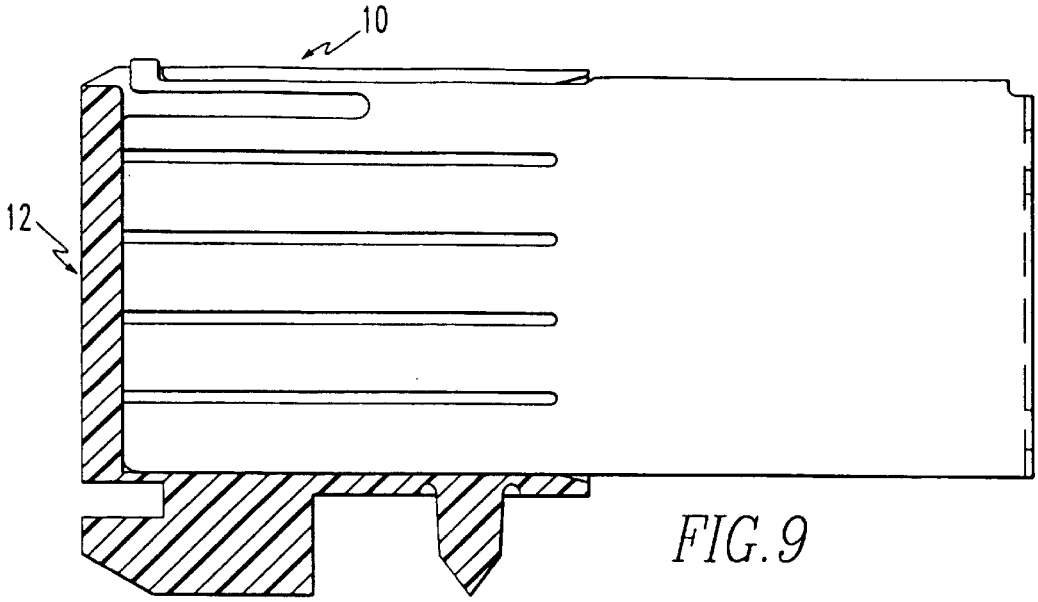
FIG. 9 is a cross sectional view through IX—IX in FIG. 8.
Figure 10:
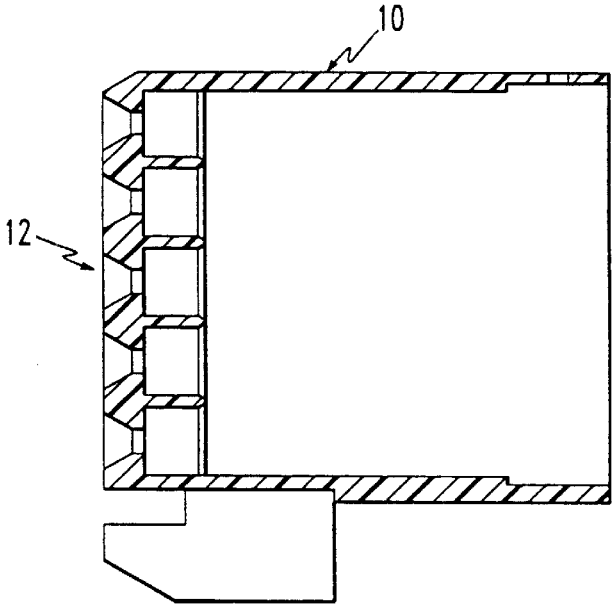
FIG. 10 is a cross sectional view through X—X in FIG. 8.

Referring to FIGS. 5 and 7–8 particularly, it will be seen that in addition to terminal 18, insulative frame 94 also holds signal terminal 124, 126, 128 and 130. Each of these terminals extends first upwardly and then horizontally. Each of these terminals has, respectively, at its horizontal terminal end a split pin engagement section 132, 134, 136, 138 and 140. As is conventional, the receptacle also has a pair of code key holders 142 and 144 and press pins 146, 148 and 150.

Figure 11:
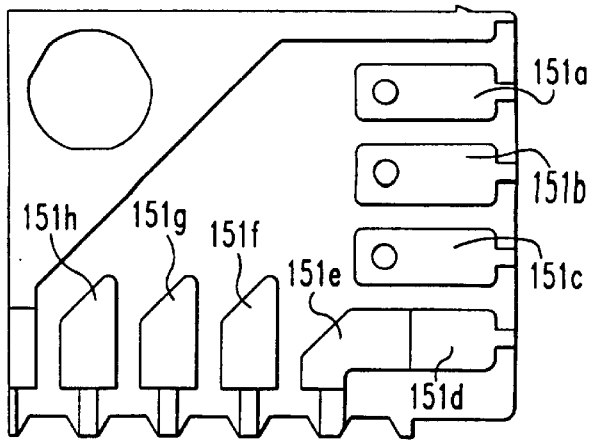
FIG. 11 is a vertical cross sectional view through an insulative frame as is shown in FIG. 4.

Referring to FIG. 11, an insulative frame is shown as being vertically bisected. This bisected frame is centrally recessed and has a plurality of contact receiving structures 151*a*–151*h*.

Figure 12:
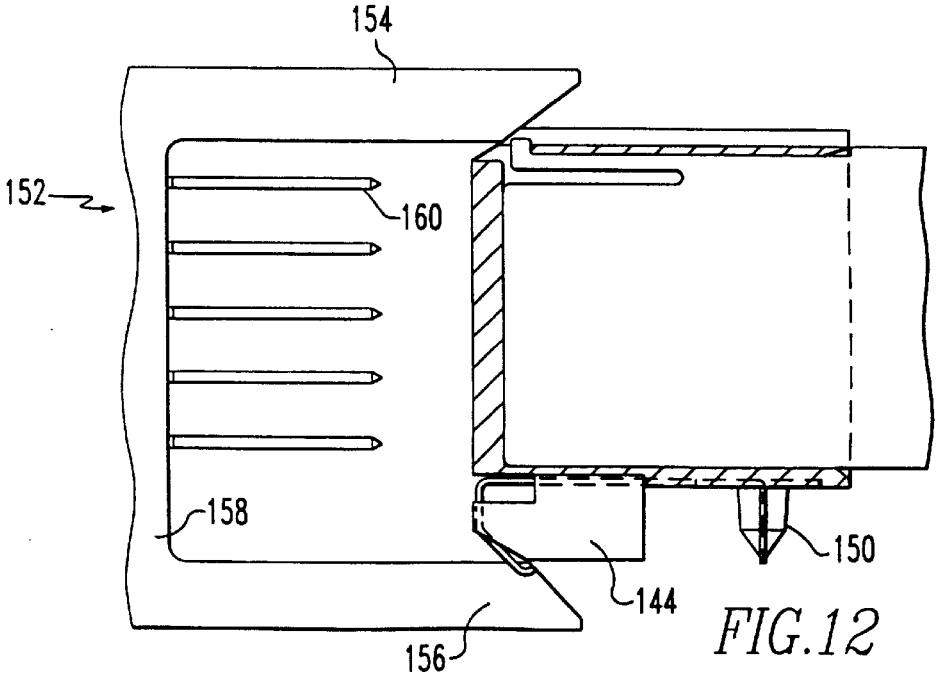
FIG. 12 is a vertical cross sectional view of the receptacle shown in FIG. 1 engaged with a header.

Referring to FIG. 12, the receptacle engages a header shown generally at numeral 152. The header has a pair of end walls 154 and 156 and a medial wall. There are apertures in the medial wall through which conductive pins as at 160 extend to engage the first face of the receptacle and be received in the split pin engagement sections of the terminals.

Figure 13:
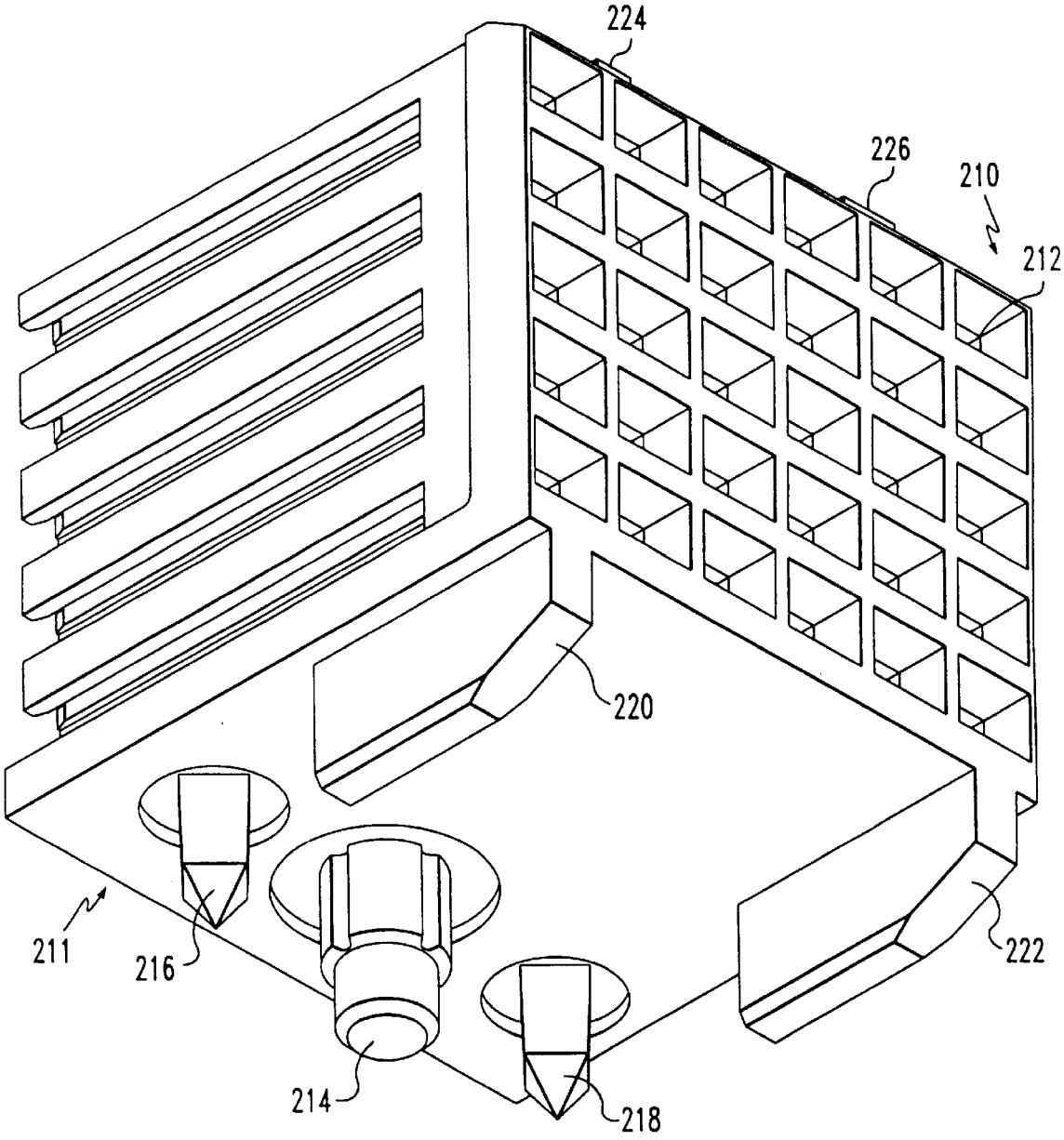
FIG. 13 is a front perspective view of a second preferred embodiment of the receptacle of the present invention.

A second embodiment is shown in FIGS. 13–20. Referring particularly to FIG. 13, the front face of the receptacle is shown generally at numeral 210 and a bottom face at 211. On this face there are conventional pin receiving apertures as at 212 for connection with the plug. The receptacle also includes, as is conventional, a press attachment peg 214 and location pegs 216 and 218. Also included are spacers 220 and 222 and polarization alignment keys 224 and 226.

Figure 14:
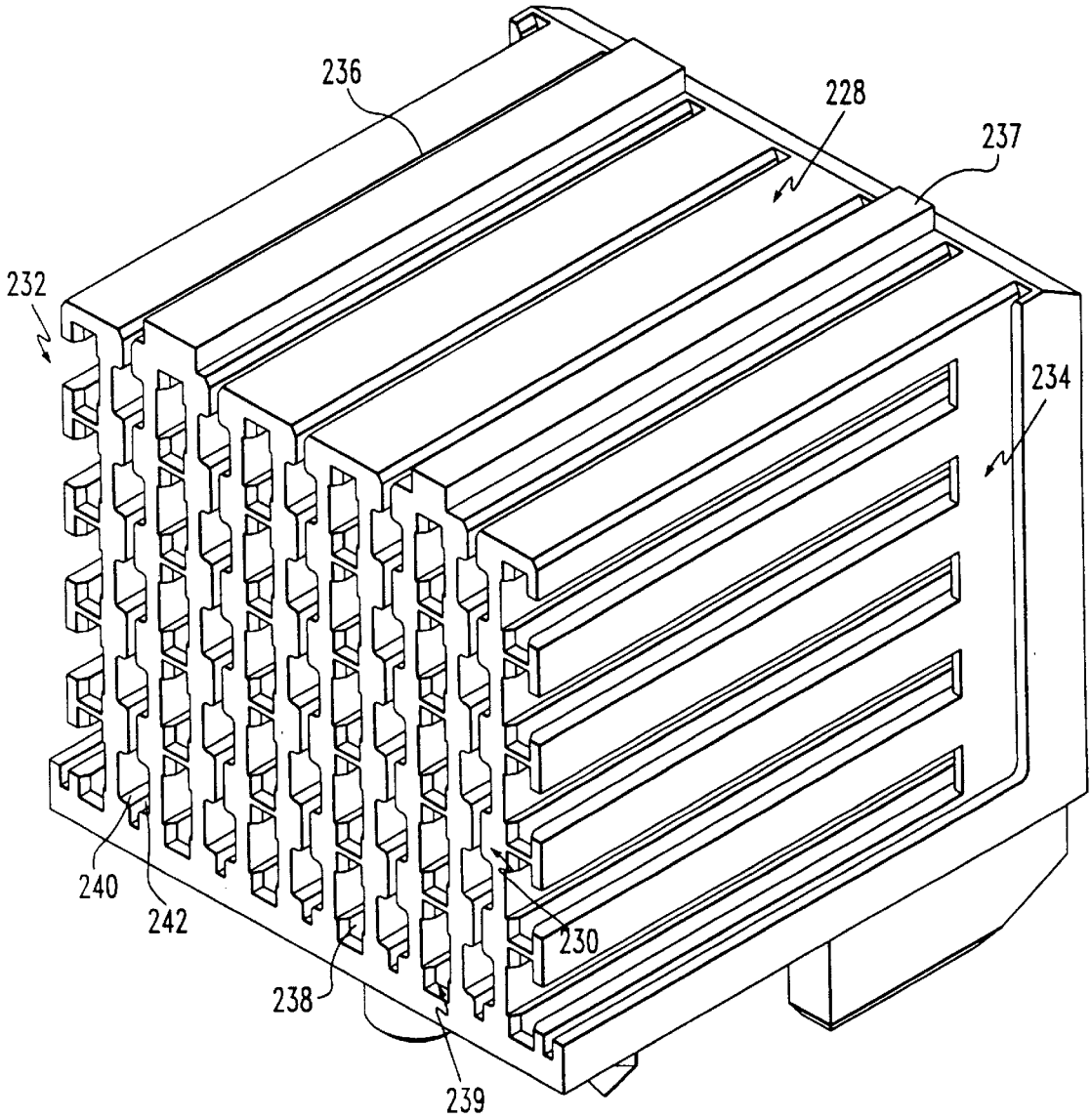
FIG. 14 is a rear perspective view of the receptacle shown in FIG. 13.
Figure 15:
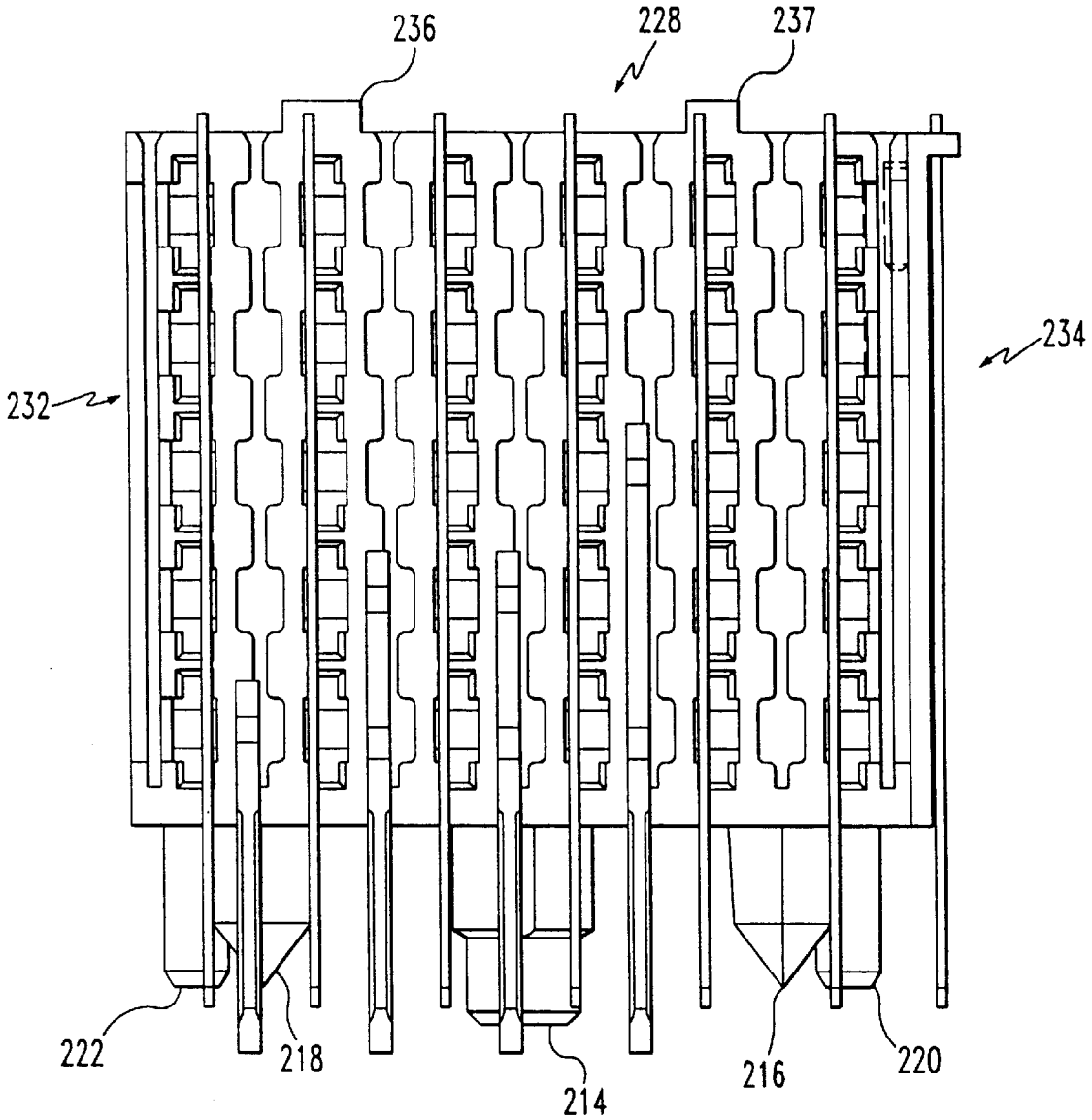
FIG. 15 is a rear elevational view of the receptacle shown in FIG. 13.

Referring particularly to FIGS. 14–15, the top face 228, rear face 230 and a side face 232 and 234 are shown in greater detail. From this figure it will be seen that there are slots as at 236 and 237 for receiving shields in the top face, bottom face and rear face which run parallel to the side faces. Between the shields there are elongated contact receiving slots as at 238 and 239. At vertical spaced intervals along the shield receiving slot there are also pairs of grooves 240 and 242.

Figure 16:
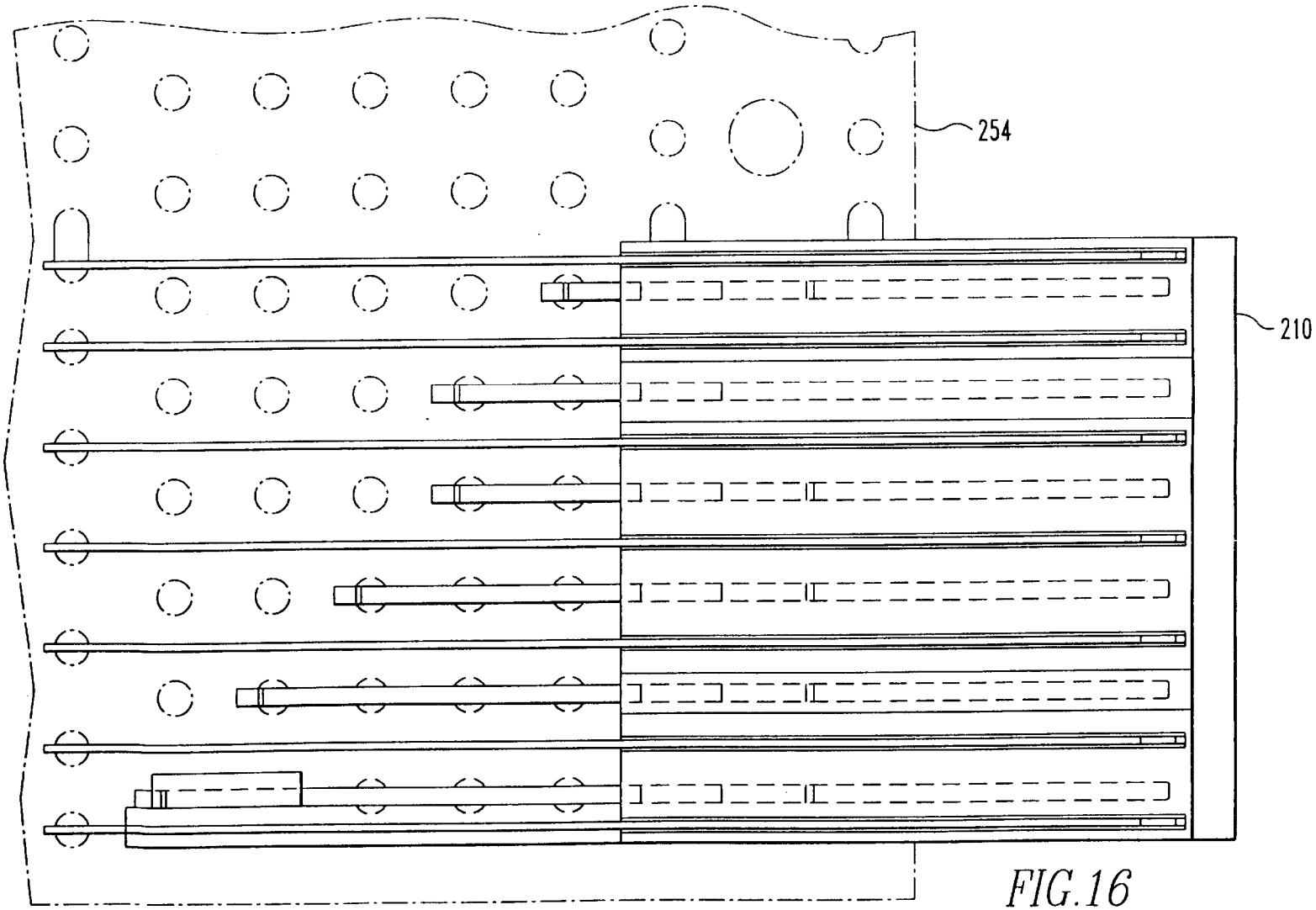
FIG. 16 is a schematic top cutaway view showing the receptacle engaging a printed circuit board.
Figure 17A:
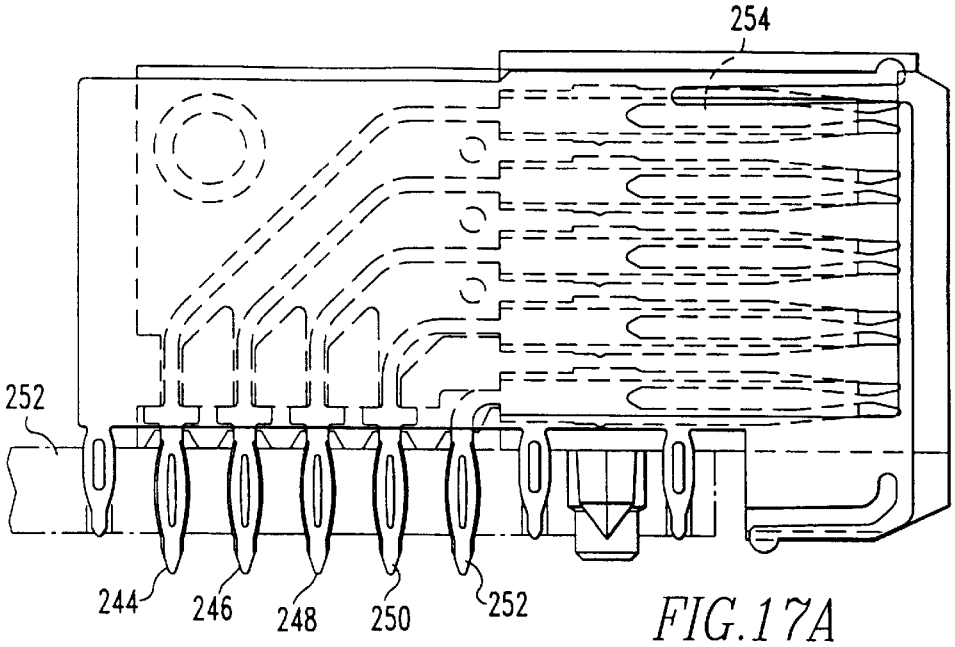
FIG. 17A is a cross sectional view through XVII—XVII in FIG. 15.
Figure 17B:
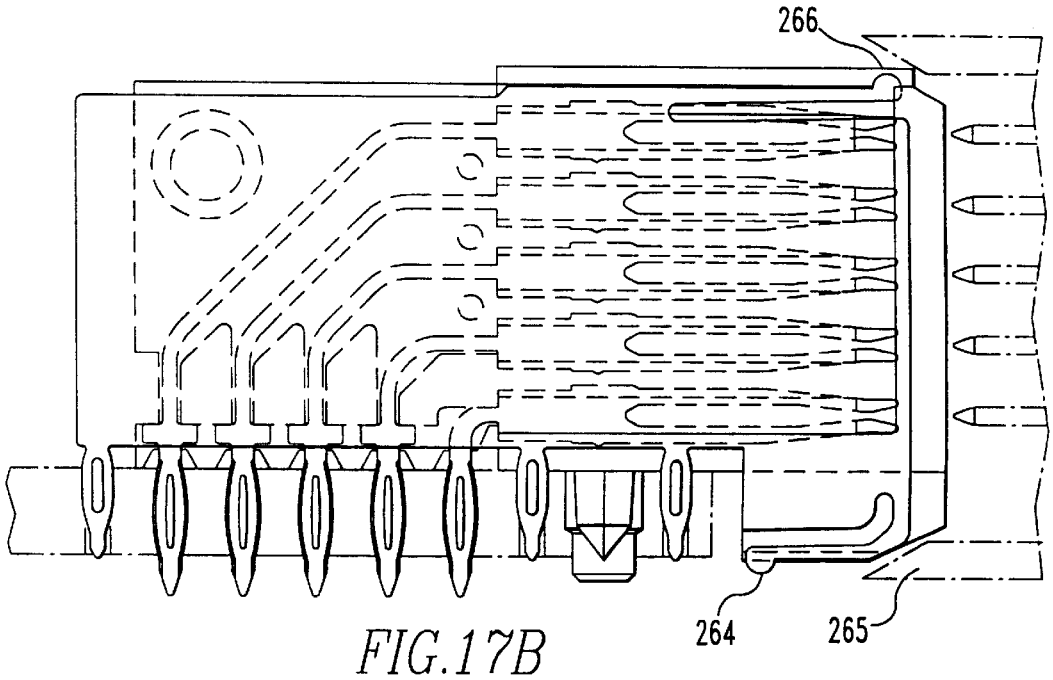
FIG. 17B is a cross sectional view similar to FIG. 17A in which the receptacle is shown engaging a header.
Figure 18:
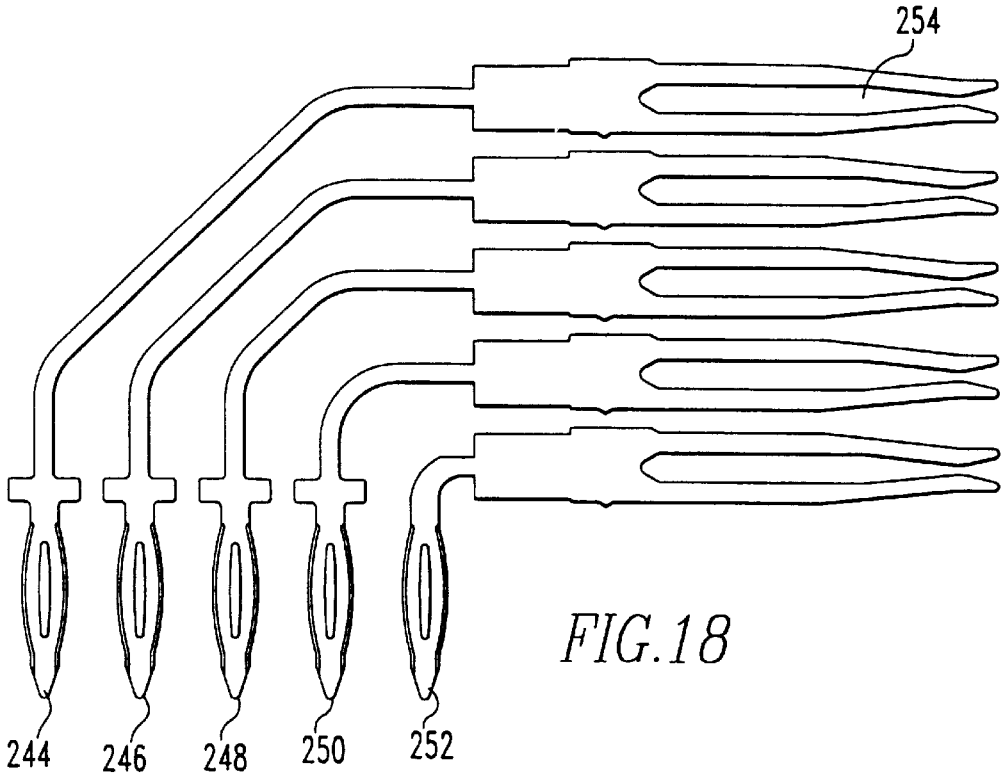
FIG. 18 is a side elevational view of a shield used in a receptacle used in FIG. 13.
Figure 19:
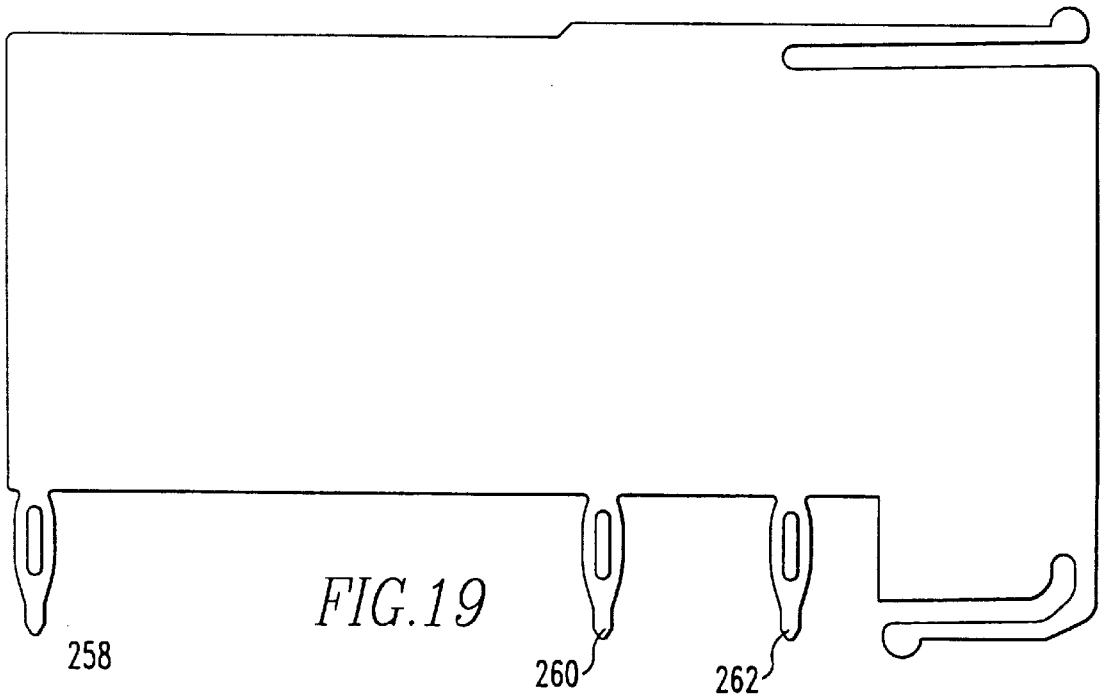
FIG. 19 is a side elevational view of contacts used in the receptacle shown in FIG. 13.

Referring particularly to FIGS. 16–20 signal contacts as at 244, 246, 248, 250 and 252 pass through each of the contact receiving slots in the receptacle. These contacts are connected at one end to the printed circuit board 254 (FIG. 16). (It will be understood that the contacts between individual sets of shields all extend rearwardly by the same overall length although in FIG. 16 engagement of the printed circuit board schematically shows several different rearward positions to illustrate various positions on the board which may be engaged by the contacts.) At their other end they have a V-shaped structure as at 256 to engage pins at the pin receiving apertures. Referring particularly to FIGS. 17A–17B and 19 the shields have ground pins as at 258, 260 and 262 that pass through the bottom face of the receptacle to be grounded to the PCB. The shield also has a lower resilient ground 264 which extends downwardly through a lower slot in the receptacle then rearwardly to be grounded to a shrouded header 265 (FIG. 17B). Similarly the shield has an upper resilient ground structure 266 which passes through one of the slots in the upper face of the receptacle to be grounded to a header (not shown). A header which would be suitable for engagement with these resilient ground projections would, for example, be either one shown in U.S. patent application Ser. No. 08/277,989 filed Apr. 4, 1995 and assigned to the assignee of this application.

It will be appreciated that there has been described a simple and inexpensive receptacle which provides for effective shielding and grounding between mother and daughter boards.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A shield arrangement for an electrical connector, comprising:

an external conductive shield enclosing the electrical connector and having at least one inwardly directed projection; and an internal conductive shield at least partially residing within the electrical connector and having at least one feature engaging said at least one projections;

wherein said at least one feature includes at least one notch, and said at least one projection extends into said at least one notch.

2. The shield arrangement as recited in claim 1, wherein said at least one projection comprises at least one eyelet and said at least one feature comprises at least one latch receivable in said at least one eyelet.

3. The shield arrangement as recited in claim 1, wherein said external shield comprises a rear wall extending along a rear of the electrical connector, said at least one projection residing on said rear wall.

4. The shield arrangement as recited in claim 3, wherein said external shield further comprises a top wall extending along a top of the electrical connector.

5. The shield arrangement as recited in claim 1, wherein said internal shield comprises a plurality of generally planar conductive elements extending between adjacent columns of contacts in the electrical connector.

6. The shield arrangement as recited in claim 5, wherein each of said plurality of planar conductive elements includes said at least one feature to receive said at least one projection.

7. An electrical connector, comprising:

a housing;

a plurality of contacts extending through said housing;

an external conductive shield enclosing said housing and having at least one inwardly directed projection; and an internal conductive shield at least partially residing within said housing and having at least one feature engaging said at least one projection;

wherein said at least one feature includes at least one notch, and said at least one projection extends into said at least one notch.

8. The electrical connector as recited in claim 7, wherein said plurality of contacts are arranged in a plurality of columns, and said internal shield resides between adjacent ones of said plurality of columns.

9. The electrical connector as recited in claim 8, wherein said internal shield comprises a plurality of generally planar conductive elements, each extending between adjacent ones of said plurality of columns.

10. The electrical connector as recited in claim 7, wherein said at least one projection comprises at least one eyelet and said at least one feature comprises at least one latch receivable in said at least one eyelet.

11. The electrical connector as recited in claim 7, wherein said external shield comprises a rear wall extending along a rear of said housing, said at least one projection residing on said rear wall.

12. The electrical connector as recited in claim 11, wherein said external shield further comprises a top wall extending along a top of said housing.

13. The electrical connector as recited in claim 9, wherein each of said plurality of planar conductive elements includes said at least one feature to receive said at least one projection.

14. A receptacle electrical connector, comprising:

a housing having a front face with a plurality of apertures arranged in a plurality of columns;

a plurality of contacts in said housing and arranged in a plurality of columns, each of said contacts having a mating end adjacent a corresponding one of said openings;

an external conductive shield enclosing said housing and having at least one inwardly directed projection; and an internal conductive shield at least partially residing within said housing at a location between adjacent ones of said plurality of columns of contacts, and having at least one feature engaging said at least one projections;

wherein said at least one feature includes at least one notch, and said at least one projection extends into said at least one notch.

15. The receptacle as recited in claim 14, wherein said internal shield comprises a plurality of generally planar conductive elements, each extending between adjacent ones of said plurality of columns of contacts.

16. The receptacle as recited in claim 14, wherein said at least one projection comprises at least one eyelet and said at least one feature comprises at least one latch receivable in said at least one eyelet.

17. The receptacle as recited in claim 14, wherein said external shield comprises a rear wall extending along a rear of said housing, said at least one projection residing on said rear wall.

18. The receptacle as recited in claim 17, wherein said external shield further comprises a top wall extending along a top of said housing.

19. The receptacle electrical connector as recited in claim 15, wherein each of said plurality of planar conductive elements includes said at least one feature to receive said at least one projection.

* * * * *